US010436210B2

(12) United States Patent
Walker

(10) Patent No.: US 10,436,210 B2
(45) Date of Patent: Oct. 8, 2019

(54) SLURRY PUMP IMPELLER

(71) Applicant: Weir Minerals Australia Ltd., Sydney (AU)

(72) Inventor: Craig Ian Walker, Warriewood (AU)

(73) Assignee: WEIR MINERALS AUSTRALIA LTD. (AU)

( * ) Notice: Subject to any disclaimer, the term of this patent is extended or adjusted under 35 U.S.C. 154(b) by 259 days.

(21) Appl. No.: 15/511,628

(22) PCT Filed: Aug. 14, 2015

(86) PCT No.: PCT/AU2015/050464
§ 371 (c)(1),
(2) Date: Mar. 15, 2017

(87) PCT Pub. No.: WO2016/040999
PCT Pub. Date: Mar. 24, 2016

(65) Prior Publication Data

US 2017/0260993 A1 Sep. 14, 2017

(30) Foreign Application Priority Data

Sep. 15, 2014 (AU) ..... 2014903675
Sep. 15, 2014 (AU) ..... 2014903676

(51) Int. Cl.
*F04D 29/22* (2006.01)
*F04D 7/04* (2006.01)
*F04D 29/24* (2006.01)

(52) U.S. Cl.
CPC ..... *F04D 29/2294* (2013.01); *F04D 7/04* (2013.01); *F04D 7/045* (2013.01); *F04D 29/2288* (2013.01); *F04D 29/24* (2013.01)

(58) Field of Classification Search
CPC ..... F04D 7/045; F04D 7/04; F04D 29/2294; F04D 29/2288; F04D 29/24
See application file for complete search history.

(56) References Cited

U.S. PATENT DOCUMENTS 4,664,592 A 5/1987 Grzina
4,883,403 A * 11/1989 Walker ..... F04D 29/2266 415/98

(Continued)

FOREIGN PATENT DOCUMENTS

WO WO-97/09482 A1 3/1997
WO WO-2006/097908 A1 9/2006

(Continued)

OTHER PUBLICATIONS

European Extended Search Report for Co-Pending European Application No. 15841807.9. dated Apr. 30, 2018, 8 pgs.

(Continued)

*Primary Examiner* — Richard A Edgar
(74) *Attorney, Agent, or Firm* — Foley & Lardner LLP

(57) ABSTRACT

An impeller which can be rotated about a rotation axis X-X, the impeller comprising a shroud having opposed inner and outer faces and an outer peripheral edge portion remote from the rotation axis, a plurality of pumping vanes projecting from the inner face of the shroud, a plurality of auxiliary vanes projecting from the outer face of the shroud, one or more of the auxiliary vanes having an inner edge which is closer to the rotation axis and an outer edge which is closer to the peripheral edge portion of the shroud, the auxiliary vanes extending in a direction between the rotation axis towards the outer peripheral edge portion of the shroud, one or more of the auxiliary vanes having a leading side and a trailing side each of which extends from the inner edge to the outer edge with an upper side spaced from the outer face of the shroud, and at least one projection extending from the trailing side of one or more of the said auxiliary vanes, and preferably each auxiliary vane.

28 Claims, 18 Drawing Sheets

(56) References Cited

U.S. PATENT DOCUMENTS

| | | | | |
|---|---|---|---|---|
| 5,921,748 | A | 7/1999 | Frater | |
| 6,074,167 | A | 6/2000 | Olifirov et al. | |
| 7,329,085 | B2 | 2/2008 | Walker et al. | |
| 7,429,160 | B2 * | 9/2008 | Roudnev | F04D 29/167 415/174.3 |
| 7,470,106 | B1 | 12/2008 | Blattmann | |
| 2009/0136341 | A1 | 5/2009 | Kenyon | |
| 2010/0172751 | A1 | 7/2010 | Scott et al. | |
| 2010/0239417 | A1 | 9/2010 | Scott | |
| 2011/0129344 | A1 | 6/2011 | Burgess et al. | |
| 2012/0207606 | A1 | 8/2012 | Stephan et al. | |
| 2013/0115047 | A1 | 5/2013 | Sheth et al. | |
| 2014/0037440 | A1 | 2/2014 | Frater et al. | |
| 2014/0079558 | A1 | 3/2014 | Koivikko et al. | |
| 2014/0105747 | A1 | 4/2014 | Burgess et al. | |
| 2014/0127021 | A1 | 5/2014 | Chiovelli et al. | |

FOREIGN PATENT DOCUMENTS

| | | | |
|---|---|---|---|
| WO | WO-2008/0150464 | A1 | 12/2008 |
| WO | WO-2016040979 | A1 | 3/2016 |
| WO | WO-2016040999 | A1 | 3/2016 |

OTHER PUBLICATIONS

KETO FAP Mining Pumps & Systems, K-HEETM Impeller, [retrieved from the Internet on Nov. 24, 2014]. <URL:https://web.archive.org/web/20140307184625/http://ketopumps.com/products/k-hee-impeller-0> published on Mar. 7, 2014 as per Wayback Machine Whole document (including Features and Downloads).

Noctua Technologies [retrieved on Sep. 10, 2015]. Retrieved from the Internet. <URL: https://web.archive.org/web/20140712080504/http:/noctua.at/main.php?show=technologies&Ing=en published on Jul. 12, 2014 as per Wayback Machine Bevelled Blade Tips; Vortex-Control Notches.

Slurry Pump Handbook, Fifth Edition, published Feb. 2009 [retrieved on Sep. 10, 2015]. Retrieved from the Internet. <URL: http://www.weirminerals.com/pdf/Slurry%20Pumping%20Handbook%20-%202009.pdf> Whole document.

International Search Report for PCT/AU2015/050464 dated Sep. 14, 2015.

Written Opinion of the International Search Authority for PCT/AU2015/050464 dated Sep. 14, 2015.

Response to Written Opinion for PCT/AU2015/050464 dated Aug. 19, 2016.

Written Opinion of the International Preliminary Examing Authority for PCT/AU2015/050464 dated Sep. 8, 2016.

Response to Written Opinion for PCT/AU2015/050464 dated Oct. 5, 2016.

International Preliminary Report on Patentability for PCT/AU2015/050464 dated Nov. 1, 2016.

International Search Report for PCT/AU2014/050328 dated Nov. 26, 2014.

Written Opinion of the International Search Authority for PCT/AU2014/050328, dated Nov. 26, 2014.

International Preliminary Report on Patentability Chapter I for PCT/AU2014/050328, dated Mar. 21, 2017.

* cited by examiner

SLURRY PUMP IMPELLER

PRIORITY CLAIM

This application is a 371 filing of PCT/AU2015/050464 filed Aug. 14, 2015 which claims priority from the following applications: Australian Patent Application 2014903675 filed Sep. 15, 2014 and Australian Patent Application No. 2014903676 filed Sep. 15, 2014 the disclosures of which are incorporated by reference in their entirety for all purposes.

TECHNICAL FIELD

This disclosure relates generally to impellers for centrifugal slurry pumps. Slurries are usually a mixture of liquid and particulate solids, and are commonly found in the minerals processing, sand and gravel and/or dredging industry.

BACKGROUND ART

Centrifugal slurry pumps generally include a pump casing having a pumping chamber therein which may be of a volute configuration with an impeller mounted for rotation within the pumping chamber. A drive shaft is operatively connected to the pump impeller for causing rotation thereof, the drive shaft entering the pump casing from one side. The pump further includes a pump inlet which is typically coaxial with respect to the drive shaft and located on the opposite side of the pump casing to the drive shaft. There is also a discharge outlet typically located at a periphery of the pump casing. The pump casing may be in the form of a liner which includes a main liner, and front and back side liners, which are encased within an outer pump housing.

The impeller typically includes a hub to which the drive shaft is operatively connected, and at least one shroud. Pumping vanes are provided on one side of the shroud with discharge passageways between adjacent pumping vanes. The impeller may be of the closed type where two shrouds are provided with the pumping vanes being disposed therebetween. The shrouds are often referred to as the front shroud adjacent the pump inlet and the back shroud. The impeller may however be of the "open" face type which comprises one shroud only.

One of the major wear areas in the slurry pump is the front side-liner that is adjacent to the rotating impeller. Slurry enters the impeller in the centre or eye and is then flung out to the periphery of the impeller and into the pump casing. Because there is a pressure difference between the casing and the eye, there is a tendency for the slurry to flow back to the eye through the gap between the side-liner and the impeller, resulting in high wear on the side-liner.

In order to reduce the driving pressure on the slurry in the gap, as well as create a centrifugal field to expel particles, it is common for slurry pumps to have auxiliary or expelling vanes on the front shroud of the impeller. Auxiliary or expelling vanes may also be provided on the back shroud. The expelling vanes rotate the slurry in the gap creating a centrifugal field and thus reducing the driving pressure for the returning flow, reducing the flow velocity and thus the wear on the side-liner.

A major issue for slurry pumps is the wear of the side-liner. In many applications the side-liner is the weakest point in the pump, wearing out before any other part. Much of the wear on the side-liner is a result of the flow generated by the rotating expelling vanes. In particular there is wear from the tip or outer edge of the expelling vanes due to the creation of fluid vortices and entrained particles.

SUMMARY OF THE DISCLOSURE

In a first aspect, embodiments are disclosed of an impeller which can be rotated about a rotation axis X-X, the impeller comprising a shroud having opposed inner and outer faces and an outer peripheral edge portion remote from the rotation axis, a plurality of pumping vanes projecting from the inner face of the shroud, a plurality of auxiliary vanes projecting from the outer face of the shroud, one or more of the auxiliary vanes having an inner edge which is closer to the rotation axis and an outer edge which is closer to the peripheral edge portion of the shroud, the auxiliary vanes extending in a direction between the rotation axis towards the outer peripheral edge portion of the shroud, one or more of the auxiliary vanes having a leading side and a trailing side each of which extends from the inner edge to the outer edge with an upper side spaced from the outer face of the shroud, and at least one projection extending from the trailing side of one or more of the said auxiliary vanes, and preferably each auxiliary vane.

In certain embodiments, two shrouds are provided one being a front shroud and the other being a back shroud each having opposed inner and outer faces said pumping vanes extending between the inner faces of the shrouds, the front shroud having a central intake opening therein with a first group of said auxiliary vanes on the outer face thereof which are disposed between the intake opening and the outer peripheral edge portion of the front shroud.

In certain embodiments, a second group of said auxiliary vanes are disposed on said outer face of the back shroud.

In certain embodiments, the outer edge of the auxiliary vanes is spaced inwardly from the outer peripheral edge portion of the shroud.

In certain embodiments, the outer edge of the auxiliary vanes is at the peripheral edge portion of the shroud.

In certain embodiments, one or more and preferably each auxiliary vane comprises a plurality of said projections disposed in spaced apart relation on the trailing side thereof.

In certain embodiments, one of the projections is an inner-most projection and another is an outer-most projection, the outer-most projection being more closely spaced from the outer edge of the auxiliary vane than the inner-most projection is.

In certain embodiments, the inner-most projection is more closely spaced from the inner edge of the auxiliary vane than the outer-most projection is.

In certain embodiments, each projection has a length C which is taken from the trailing side of the auxiliary vane with which it is associated, to the end side thereof wherein, where there are a plurality of projections, the length of the projections C is about the same.

In certain embodiments, each projection has a length C which is taken from the trailing side of the auxiliary vane with which it is associated, to the end side thereof wherein, where there are a plurality of projections, the length of at least one of the projections is different to the other projection(s). In certain embodiments, the length of the outermost projection is the longest and the innermost projection is the shortest.

In certain embodiments, each projection has a top side remote from the outer face of the shroud with which it is associated and the upper side of the auxiliary vane with which it is associated has a main surface and where HE is the height of the auxiliary vane from the outer face of the shroud to the main surface of the upper side of the auxiliary vane and H is the height of the projection from the outer face of the shroud to the top side of the projection.

In certain embodiments, H is less than 0.7 of HE. In certain embodiments H ranges from 0.2 to 0.69 of HE.

In certain embodiments, the vanes have one projection associated therewith wherein H is generally equal to HE. In certain embodiments, the vanes have two projections associated therewith wherein H is generally equal to HE. In certain embodiments, the vanes have two projections associated therewith wherein H is less than HE. In certain embodiments, the vanes have associated therewith two projections wherein for one projection H is generally equal to HE and for the other projection H is less than HE.

In certain embodiments, the upper side has a stepped surface 73 which is stepped down from the main surface and is in the region of the outer edge.

In certain embodiments, each projection is generally oblong in shape and includes an inner side closest to the rotation axis X-X, an outer side remote from the rotation axis, and an end side which is remote from the auxiliary vane with which the projection is associated.

In certain embodiments, where DE is the length in a radial direction from the rotation axis to the outer edge of the auxiliary vane and DF1 is the length in a radial direction from the rotation axis X-X to the end side of an outer-most projection, and arranged such that DF1 is less than 0.95 of DE. In certain embodiments, DF1 ranges from 0.85 to 0.94 of DE.

In certain embodiments, where DE is the length in a radial direction from the rotation axis to the outer edge of the auxiliary vane and DF2 is the length in a radial direction from the rotation axis X-X to the outer side of an intermediate projection, DF2 is less than 0.85 DE. In certain embodiments, DF2 ranges from 0.35 to 0.84 of DE.

In certain embodiments, where DE is the length in a radial direction from the rotation axis to the outer edge of the auxiliary vane and DF3 is the length in a radial direction from the rotation axis X-X to the outer side of an inner-most projection, and arranged such that DF3 is less than 0.75 of DE. In certain embodiments, DF3 ranges from 0.35 to 0.74 of DE.

In certain embodiments, where T is the distance from the inner side of the projection to the outer side and DE is the length in a radial direction from the rotation axis X-X to the outer edge of the auxiliary vane, and arranged such that T ranges from 0.2 to 0.1 of DE.

In certain embodiments, where L is the angle made from the rotation axis between the trailing side of an auxiliary vane and the end side of a projection extending therefrom and LE is the angle made from the rotation axis between the trailing side of one auxiliary vane to the leading side of an adjacent auxiliary vane, and arranged such that L is less than 0.7 of LE. In certain embodiments, L ranges from 0.1 to 0.69 of LE.

Other aspects, features, and advantages will become apparent from the following detailed description when taken in conjunction with the accompanying drawings, which are a part of this disclosure and which illustrate, by way of example, principles of inventions disclosed.

BRIEF DESCRIPTION OF THE DRAWINGS

Notwithstanding any other forms which may fall within the scope of the method and apparatus as set forth in the Summary, specific embodiments of the method and apparatus will now be described, by way of example, and with reference to the accompanying drawings in which.

DETAILED DESCRIPTION OF SPECIFIC EMBODIMENTS

Figure 1:
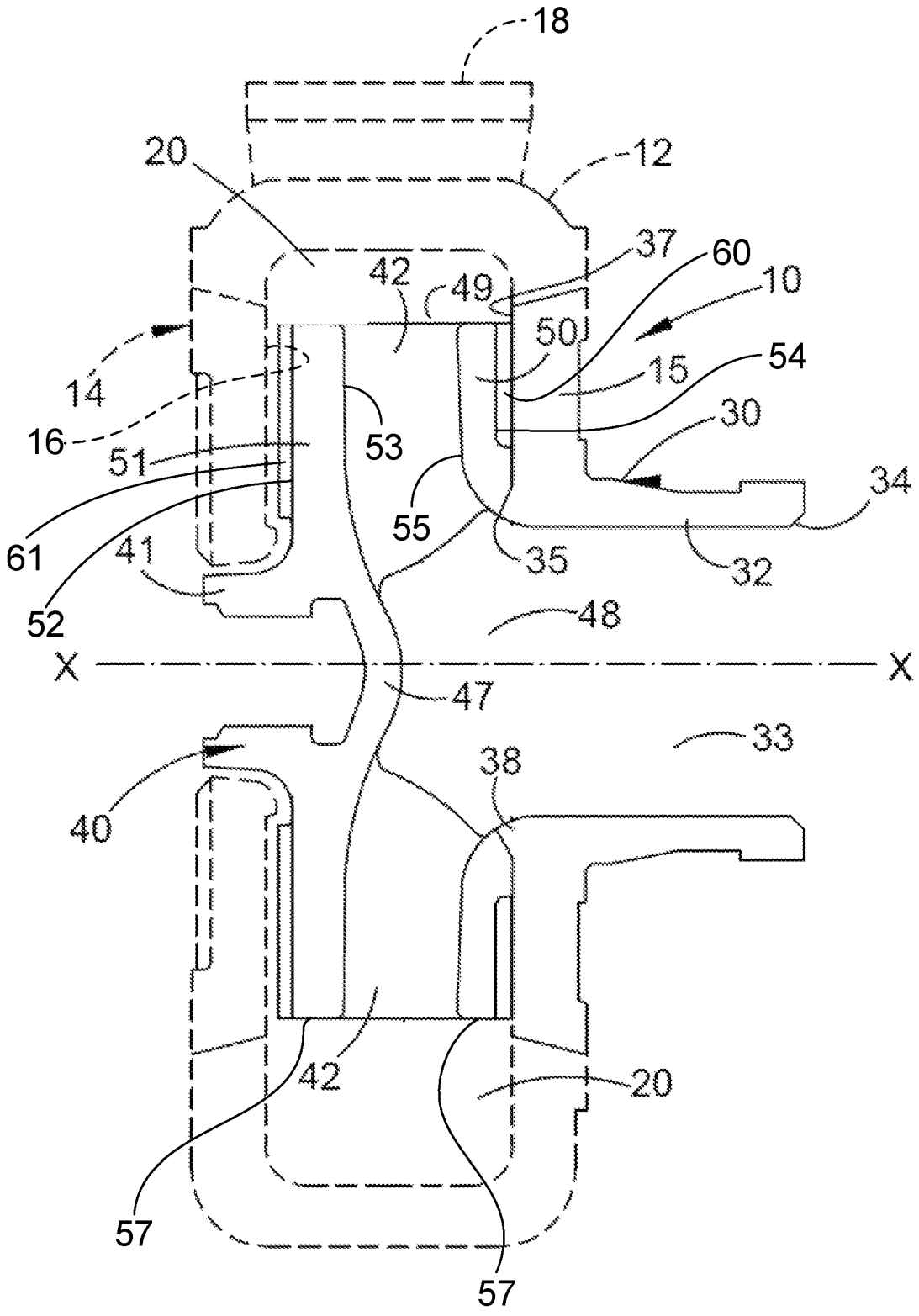
FIG. 1 illustrates an exemplary, schematic, partial cross-sectional side elevation of a pump.

Referring to FIG. 1, there is illustrated a typical example of a pump 10 which includes a pump casing or volute 12, a back liner 14 having an inner side face 16, a front liner 30 and a pump outlet 18. An internal chamber 20 is adapted to receive an impeller 40 for rotation about a rotational axis X-X.

The front liner 30 (or throatbush) includes a cylindrically-shaped delivery section 32 through which slurry enters the pumping chamber 20. The delivery section 32 has a passage 33 therein with a first, outermost end 34 operatively connectable to a feed pipe (not shown) and a second, innermost end 35 adjacent the chamber 20. The front liner 30 further includes a side wall section 15 which mates in use with the pump casing 12 to form and enclose the chamber 20, the side wall section 15 having an inner face 37. The second end 35 of the front liner 30 has a raised lip 38 thereat, which is arranged in a close facing relationship with the impeller 40.

The impeller 40 includes a hub 41 from which a plurality of circumferentially spaced pumping vanes 42 extend. An eye portion 47 extends forwardly from the hub towards the passage 33 in the front liner. The impeller further includes a front shroud 50 and a back shroud 51, the vanes 42 being disposed therebetween.

The front shroud 50 includes an inner face 55, an outer face 54 and a peripheral edge portion 56. The back shroud 51 includes an inner face 53, an outer face 52 and a peripheral edge portion 57. The front shroud 50 includes an inlet 48 and the vanes 42 extend between the inner faces of the shrouds. The shrouds are generally circular when viewed in elevation; that is in the direction of rotation axis X-X.

As illustrated in FIG. 1, each shroud has a plurality of auxiliary or expelling vanes on the outer faces thereof, there being a first group of auxiliary vanes 60 on the outer face of the front shroud 50 and a second group of auxiliary vanes 61 on the outer face of the back shroud 51. In the embodiments shown, the auxiliary vanes are generally linear, or rectangular in shape when viewed in plan and extend generally radially from the rotation axis. The vanes could however be of other shapes, for example inclined backwardly or curved relative to a radial line extending from the rotation axis, or include a combination of linear and curved portions.

FIGS. 2, 3, 4 and 10 to 18 illustrate various embodiments of the first group of vanes 60 on the outer face of front shroud 50. Reference numerals have been included on one of the vanes only for the sake of clarity. As shown, the auxiliary vanes 60 comprise a leading side 66, and a trailing side 67 with respect to the direction of rotation, as well as an upper side 69, an inner edge or side 63 and an outer edge or side 65. The inner and outer edges or sides 63, 65 extend between leading side 66 and trailing side 67. The leading side 66 of the auxiliary vanes 60 may be generally linear or straight and may extend in a generally radial direction with respect to the central axis X-X. The trailing side 67 may also be generally linear or straight, and be angularly inclined with respect to the leading side 66 so that the auxiliary vanes 60 widen as they extend from the inner edge 63 toward the outer edge 65. This is particularly apparent in the embodiments of FIGS. 11 to 18. The leading and trailing sides may have surfaces which are substantially at right angles to the shroud surface or are angularly inclined with respect to the shroud surface.

Figure 2:
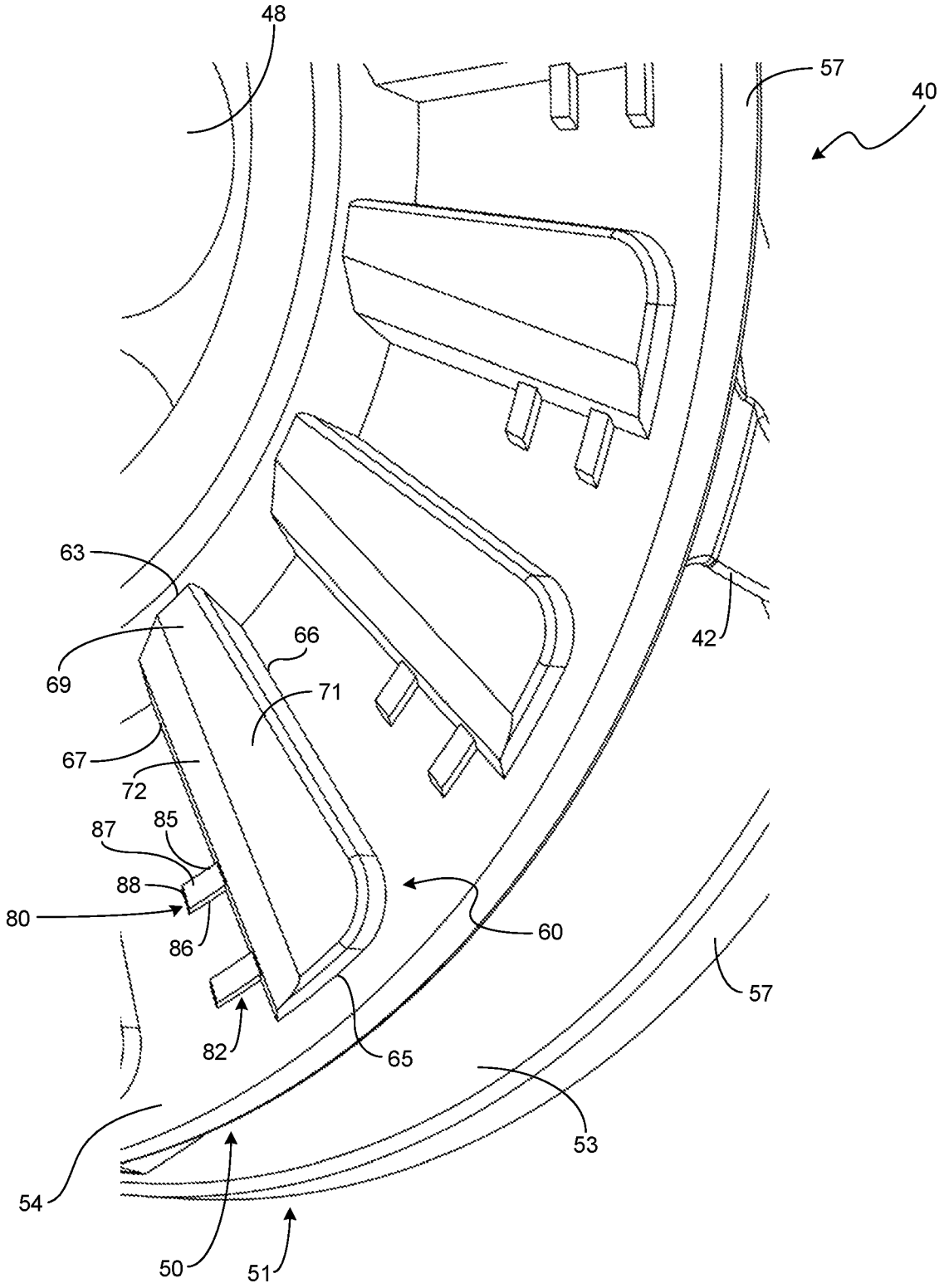
FIG. 2 is a partial schematic illustration of a pump impeller according to one embodiment of the present disclosure.
Figure 3:
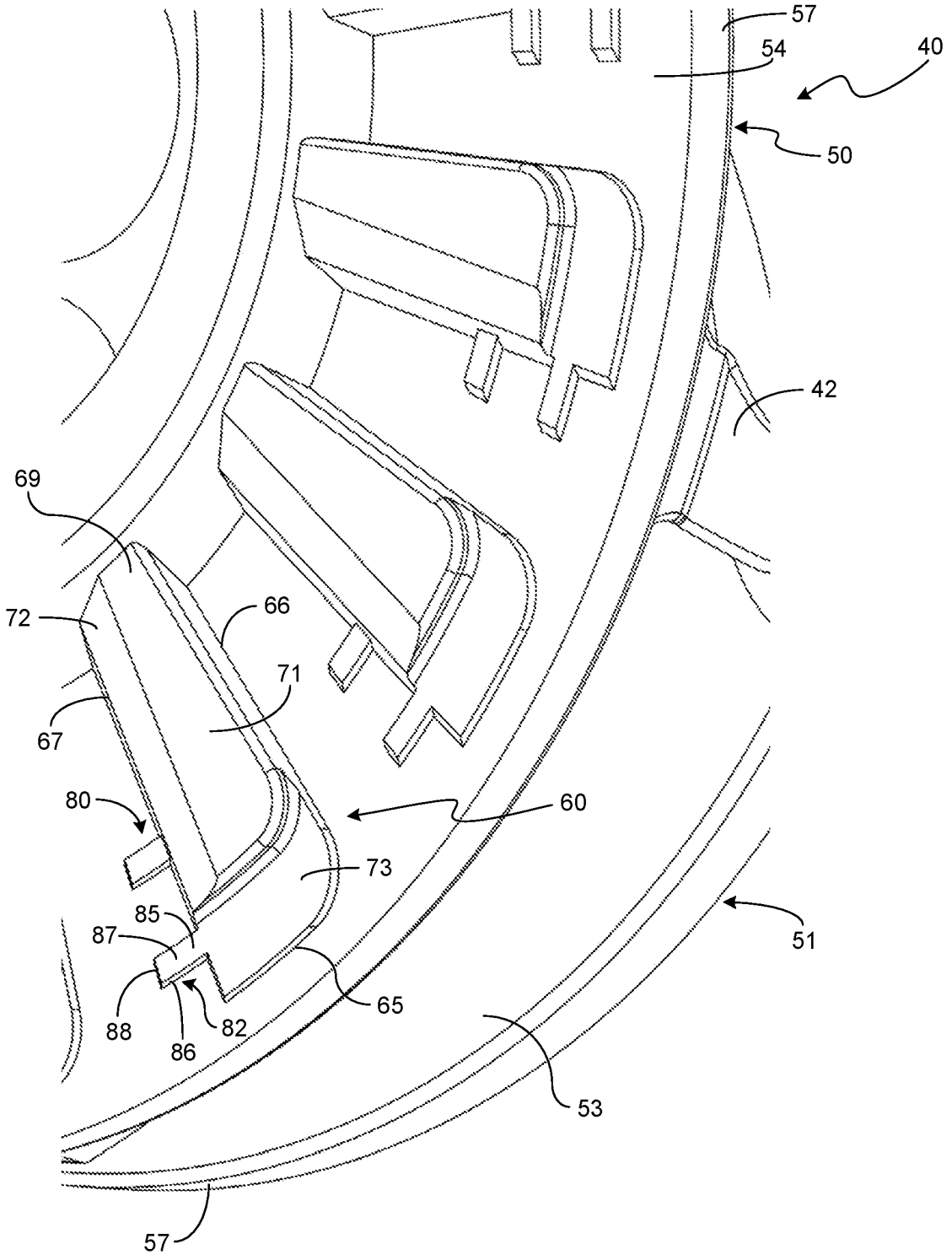
FIG. 3 is a partial schematic illustration of a pump impeller according to another embodiment of the present disclosure.
Figure 10:
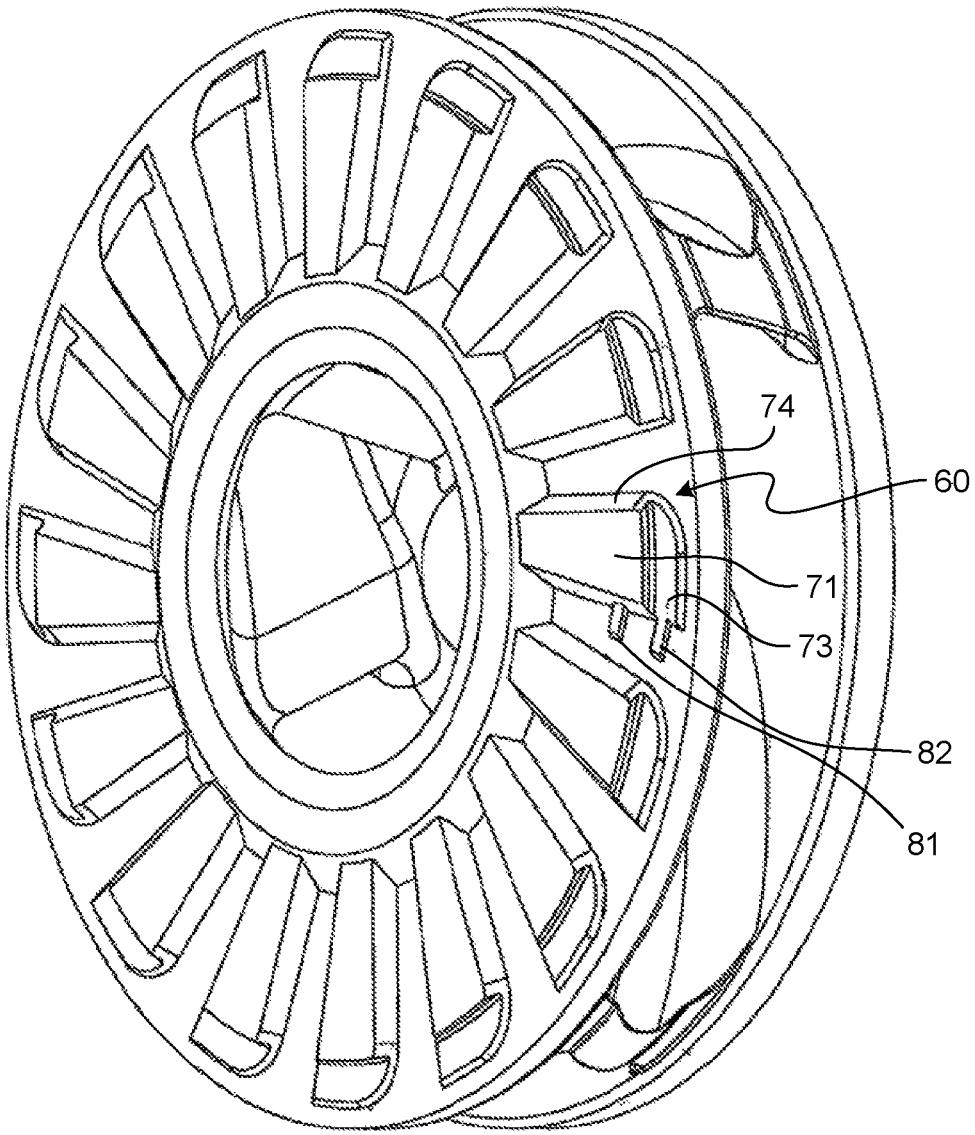
FIG. 10 is an isometric view of a pump impeller according to another embodiment of the present disclosure.

In the embodiment of FIG. 2, the upper side 69 has a main surface 71 which is generally in a plane parallel with the shroud outer surface 54 and an inclined or chamfered surface 72 which extends from the main surface 71 to the trailing side 67. In the embodiment of FIG. 3, in addition to the abovementioned features, the upper side has a stepped surface 73 which is stepped down from the main surface 71 and is in the region of the outer edge 65 of the auxiliary vanes, there being a step or shoulder between the surfaces. All of the surfaces are generally flat or planar. In the embodiment of FIG. 10, the upper side 69 has a further inclined or chamfered surface 74 at the leading side. In that FIG. 10, only one of the vanes 60 is shown with projections but in a preferred form each of the vanes 60 have projections thereon. In an alternative embodiment and with reference to FIG. 10, the auxiliary vane may include the further inclined or chamfered surface 74 at the leading edge with the main surface 71 extending toward the outer edge 65 without the inclusion of the stepped surface 73.

Figure 4A:
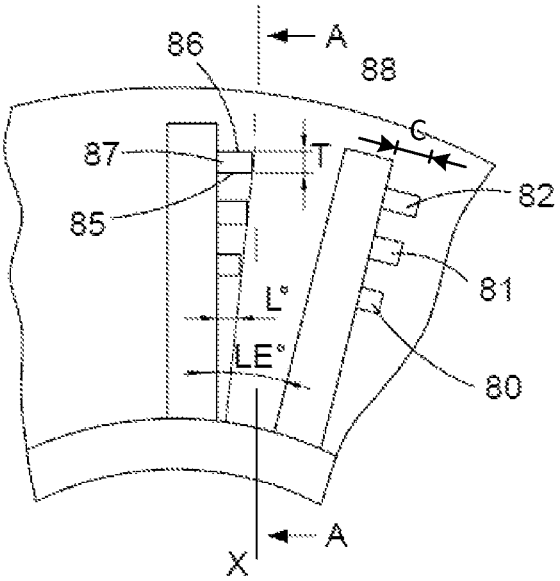
FIGS. 4(*a*) and 4(*b*) are partial elevation views of pump impellers according to further embodiments of the present disclosure.
Figure 5A:
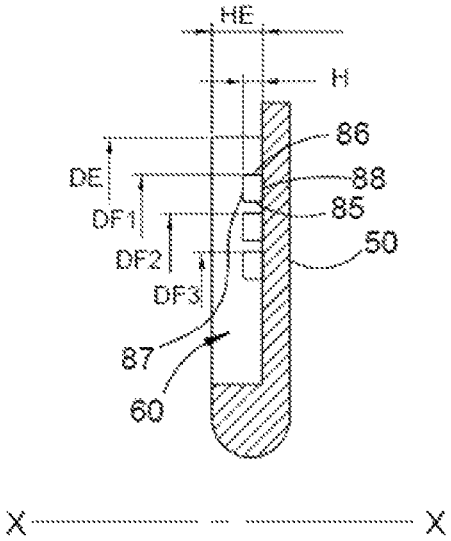
FIGS. 5(*a*) and 5(*b*) are respective, sectional views of the pump impellers shown in FIGS. 4(*a*) and 4(*b*) taken along the line A-A.
Figure 4B:
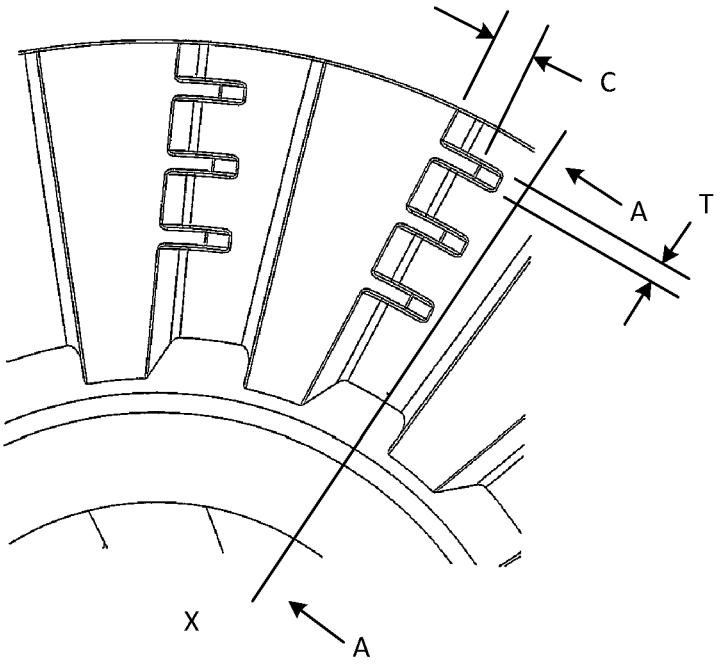
Figure 5B:
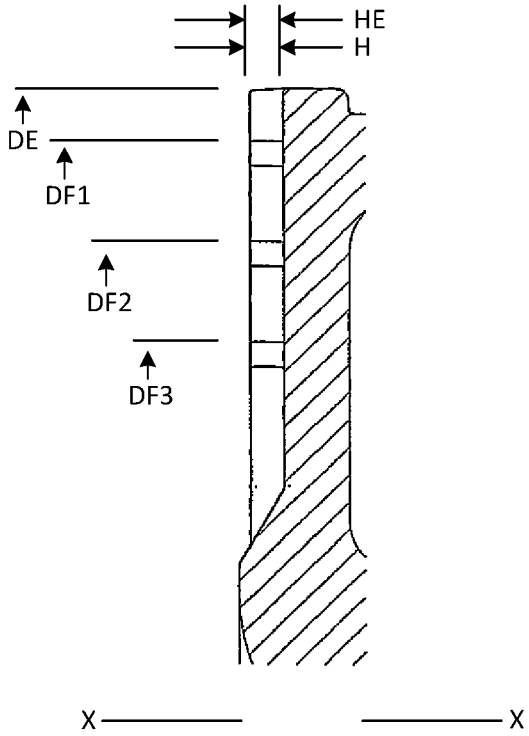

In the embodiments of FIGS. 2, 3, 4(*a*), 5(*a*) and 10, the outer edge 65 of the auxiliary vanes 60 is spaced inwardly from the outer peripheral edge portion 57 of the shroud 50. In the embodiments of FIGS. 11 to 18, the outer edge 65 of the auxiliary vanes 60 is located at the peripheral edge portion 57 of the shroud 50.

As shown in FIGS. 2 to 4, and FIGS. 10 to 18, the auxiliary vanes 60 have associated therewith one or a plurality of projections 80, 81, 82 which extend generally laterally from the trailing side 67 of the auxiliary vanes 60, the projections being spaced apart along the length thereof. The projections 80, 81, 82 may extend at 90° to the trailing side 67 or to a radial line extending from the rotation axis X-X. In the embodiment shown in FIG. 4, three projections are provided, namely an outer-most projection 82, an inner-most projection 80 and an intermediate projection 81, depending on radial position on the auxiliary vane 60. In each embodiment, the outer-most projection 82 is spaced inwardly from the outer edge 65 of the auxiliary vane, and the inner-most projection 80 is spaced outwardly from the inner edge 63 of the auxiliary vane 60.

In the embodiments shown, the projections are generally oblong in shape and include inner and outer sides 85 and 86, a top side 87 and an end side 88. The surfaces of each of the sides are generally flat or planar. The projections have a height measured from the outer face 52 of the shroud 50 to the top side 87 of the projection, and the auxiliary vanes have a height measured from the outer face 52 of the shroud 50 to the main surface 71 of the upper side of the auxiliary vane. The projections have a length taken from the trailing side 67 of the auxiliary vane 60 with which the projection is associated to its end side 86. In the embodiments of FIGS. 2, 3, 4(*b*), 5(*b*), and FIGS. 13 to 18, the length of the projection associated with the auxiliary vane is substantially the same. In the embodiment of FIGS. 4(*a*) and 5(*a*) the length of the projections associated with the auxiliary vane 60 are different. As shown in FIG. 4(*a*) the outermost projection 82, is the longest of the three projections and the inner most projection 80 is the shortest, the middle projection 81 being of a length between that of the outermost and innermost projections 80 and 82. C is the length of the projection taken from the trailing side 67 of the auxiliary vane 60 to the end side 88 of the projection.

In the embodiment of FIG. 2, the projections 80, 82 are spaced apart from one another and positioned at the trailing side 67 of the auxiliary vane 60 both closer to the outer edge 65 than the inner edge 63. In this embodiment the top side 87 of the projections is spaced inwardly from the main surface 71 of upper side 69 of the auxiliary vane 60.

In the embodiment of FIG. 3, the projection 82 extends from the trailing side 67 of the auxiliary vane 60 in the region of the stepped surface 73 whereas the projection 80 is in the region of the main surface 71. Again the top side 87 is spaced inwardly from the main surface 71.

Figure 11:
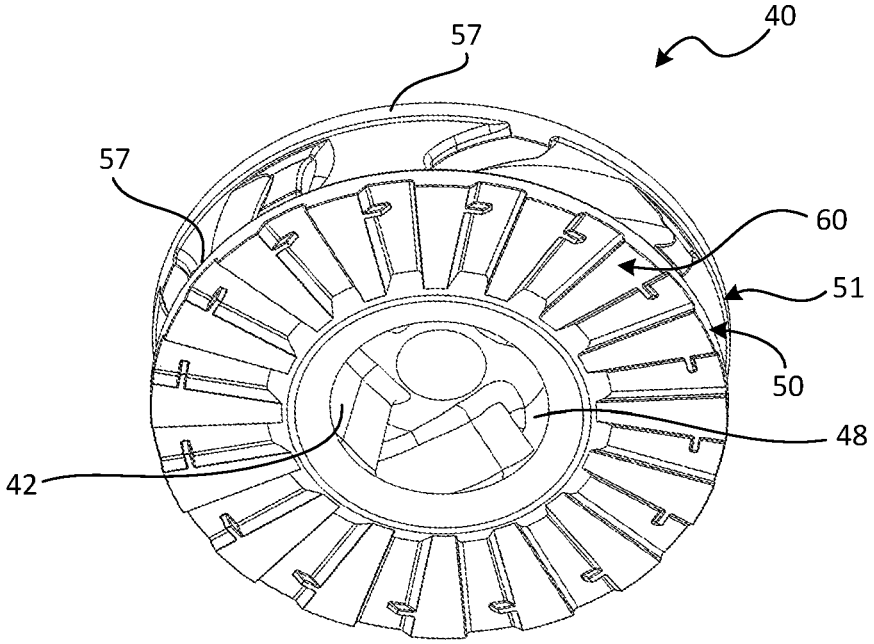
FIG. 11 is an isometric view of a pump impeller according to another embodiment of the present disclosure.
Figure 12:
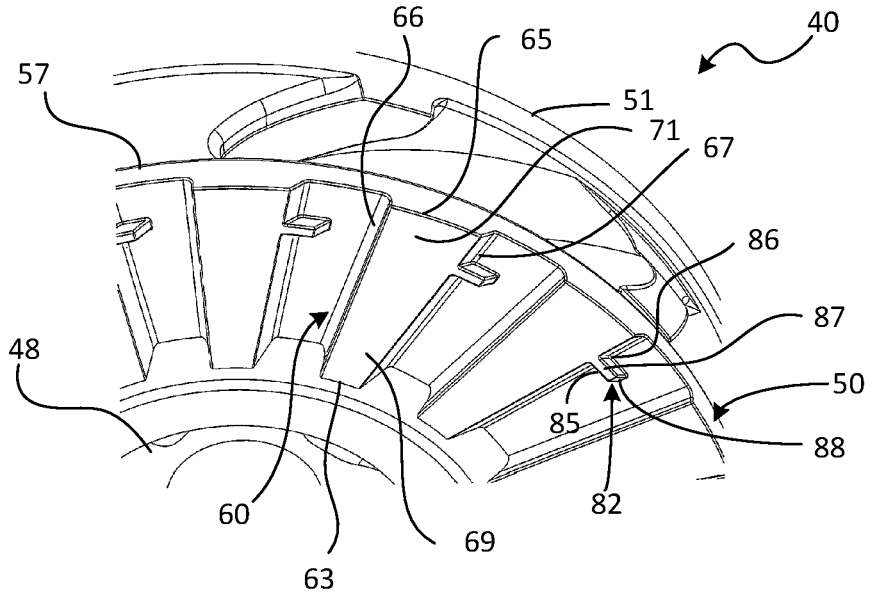
FIG. 12 is a partial schematic illustration of the pump impeller shown in FIG. 11.
Figure 13:
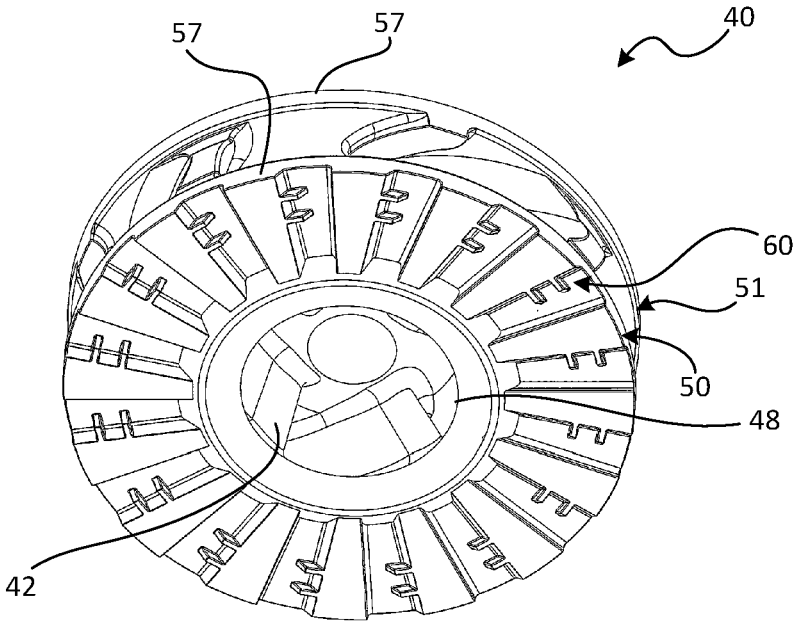
FIG. 13 is an isometric view of a pump impeller according to another embodiment of the present disclosure.
Figure 14:
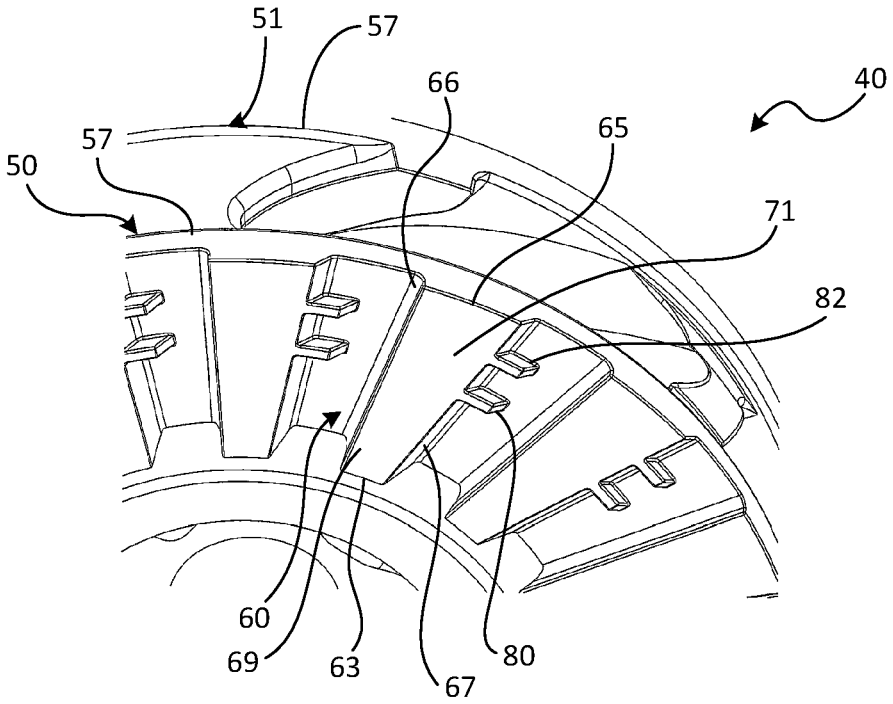
FIG. 14 is a partial schematic illustration of the pump impeller shown in FIG. 13.
Figure 15:
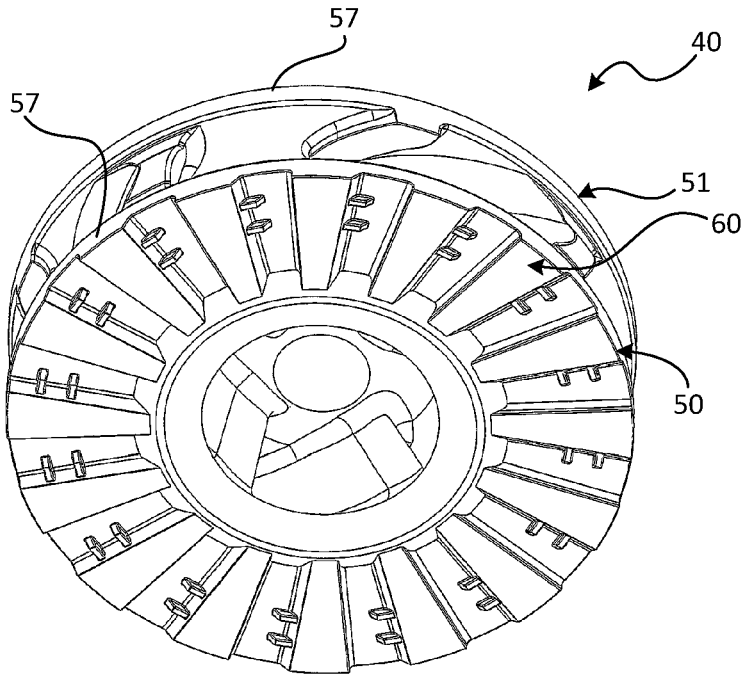
FIG. 15 is an isometric view of a pump impeller according to another embodiment of the present disclosure.
Figure 16:
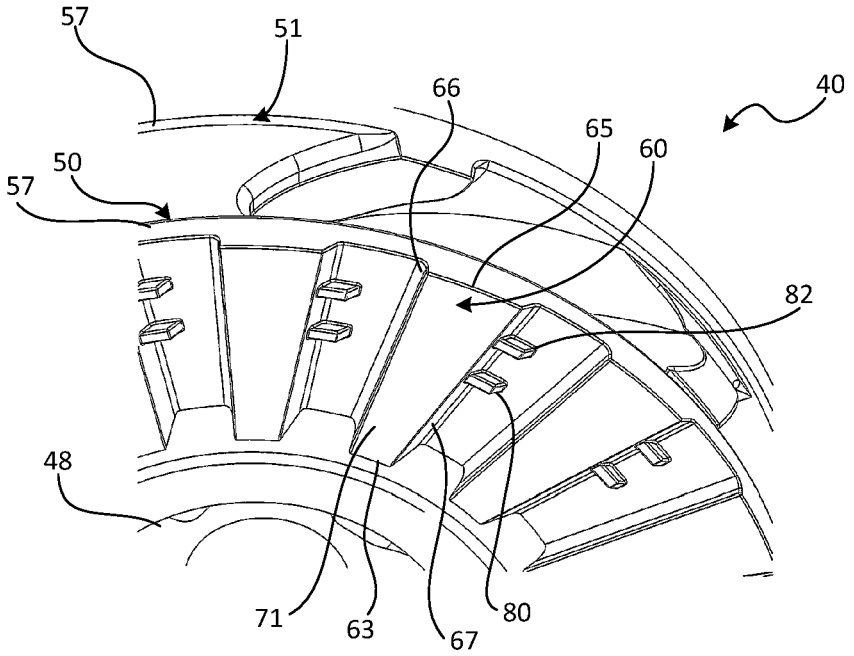
FIG. 16 is a partial schematic illustration of the pump impeller shown in FIG. 15.
Figure 17:
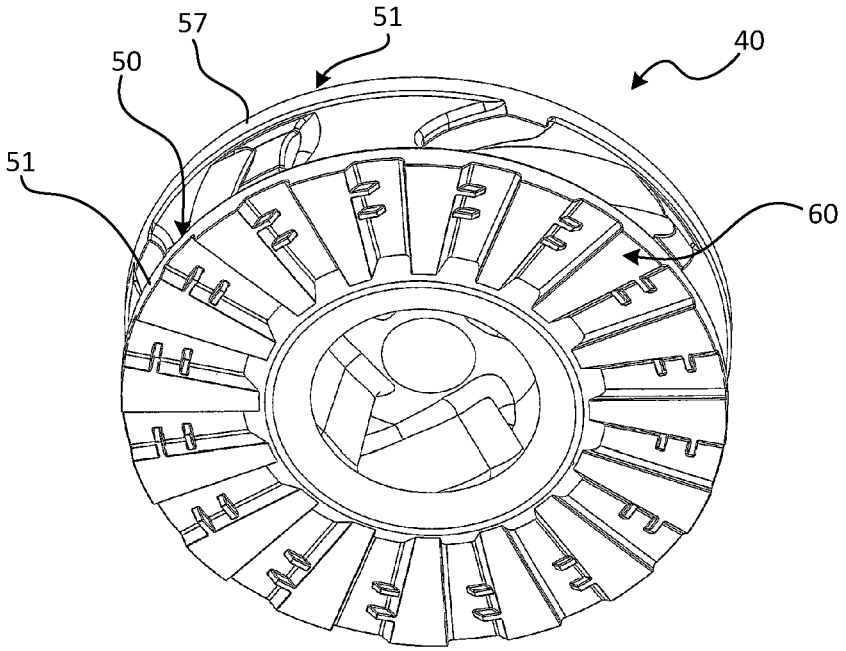
FIG. 17 is an isometric view of a pump impeller according to another embodiment of the present disclosure.
Figure 18:
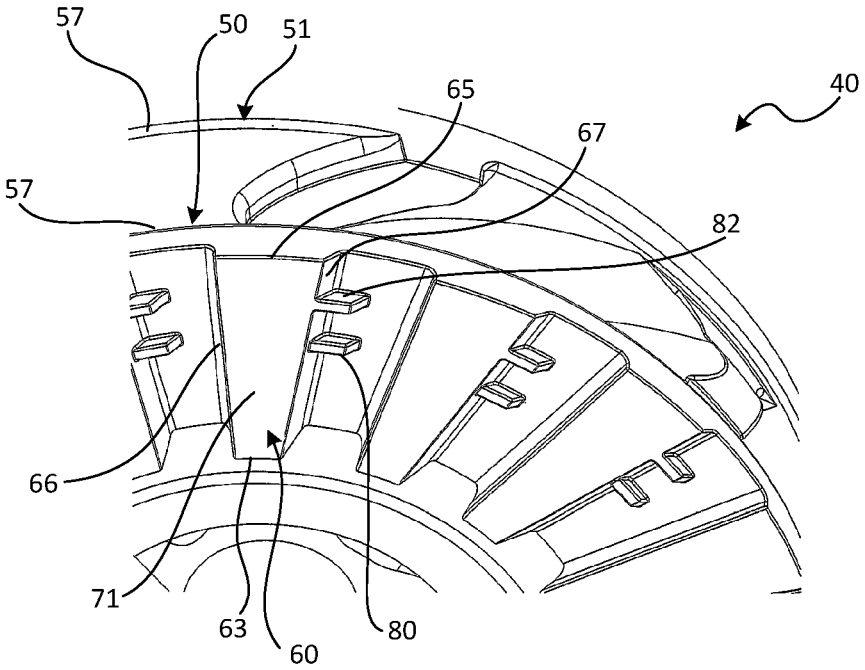
FIG. 18 is a partial schematic illustration of the pump impeller shown in FIG. 17.

In the embodiment of FIGS. 11 and 12, the projection 82 is generally the same height as the auxiliary vane 60. In the embodiment of FIGS. 13 and 14 the projections 80 and 82 are generally the same height as the auxiliary vanes 60. In the embodiment of FIGS. 15 and 16 the projections 80 and 82 are of a lesser height than the height of the auxiliary vanes 60. In the embodiment of FIGS. 17 and 18, the projection 82 is of the same height as the auxiliary vanes 60 and projection 80 is of a lesser height than the height of the auxiliary vanes 60.

In further embodiments, there are many combinations of multiple projections of different heights to one another, and spacing apart from one another, on the same auxiliary vane, and where on an adjacent auxiliary vane, there can be a different number, height and spacing apart of projections (or combinations thereof). The choice of the number of projections, and their height and distance apart from one another can be determined depending on the design parameters of the pump, and the desired wear properties. In some embodiments, the projections may only be on every second or third auxiliary vane.

In still further embodiments, the projections from the auxiliary vanes can be of different shapes to the oblong block type structure shown in the drawings, and may be cubic in shape, or angled other than at right angles from the auxiliary vane.

FIGS. 4(*a*), (*b*) and 5(*a*), (*b*) of the drawings identify the following parameters.

DE is the length in a radial direction from the rotation axis to the outer edge 65 of an auxiliary vane.

DF1 is the length in a radial direction from the rotation axis to the outer side 86 of an outer-most projection 82.

DF2 is the length in a radial direction from the rotation axis to the outer side 86 of an intermediate projection 81.

DF3 is the length in a radial direction from the rotation axis to the outer side 86 of an inner most projection 80.

HE is the height of the auxiliary vane from the outer face 52 of the shroud 50 to the main surface 71 of the upper side 69 of the auxiliary vane.

H is the height of the projection from the outer face 52 of the shroud 50 to the top side 87 of the projection.

T is the distance from the inner side 85 to the outer side 86 of the projection.

LE is the angle made from the rotation axis between the trailing side 67 of one auxiliary vane to the leading side 66 of an adjacent auxiliary vane.

L is the angle made from the rotation axis between the trailing side 67 of an auxiliary vane and the end side 88 an end of a projection.

C is the length of the projection taken from the trailing side 67 of the auxiliary vane 60 to the end side 88 of the projection.

Preferably one or more of these parameters have dimensional ratios in the following ranges.

DF1 is less than 0.95 of DE and preferably DF1 is in the range from 0.85-0.94 of DE. In one example embodiment DF1=90 mm, and DE=100 mm.

DF2 is less than 0.85 of DE and preferably DF2 is in the range from 0.35-0.84 of DE. In the aforementioned example embodiment, DF2=70 mm.

DF3 is less than 0.75 of DE and preferably DF3 is in the range from 0.35-0.74 of DE. In the aforementioned example embodiment, DF3=50 mm.

H is less than 0.7 of HE and preferably H is in the range from 0.2-0.69 of HE. In the aforementioned example embodiment, H=4 mm and HE=10 mm.

T is from 0.2-0.1 of DE and in the example embodiment T=6 mm.

L is less than 0.7 of LE and preferably L is in the range from 0.1 to 0.69 of LE. In the aforementioned example embodiment, L=6° and LE=20°.

Experimental Simulations

Figure 6:
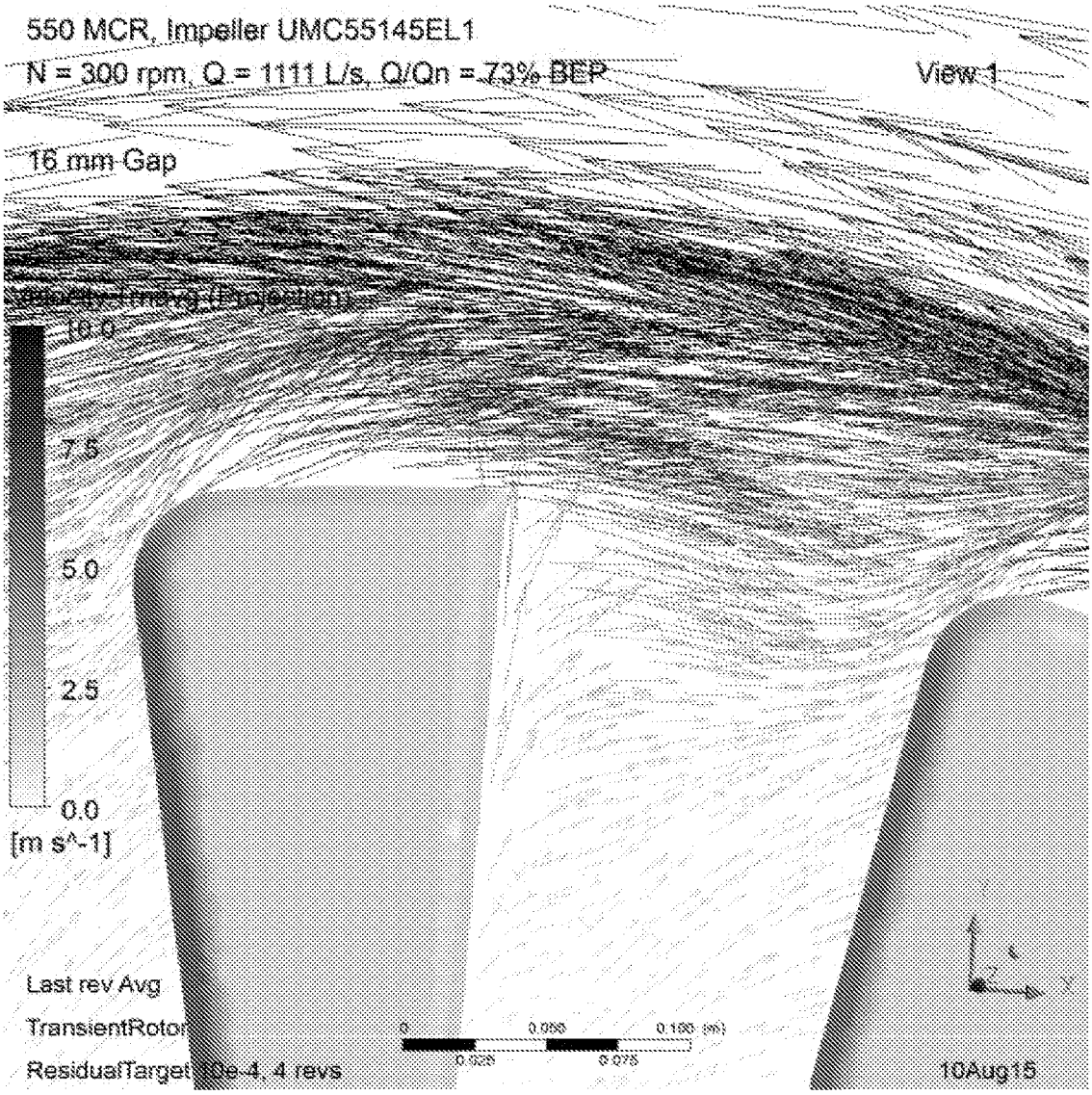
FIGS. 6 and 6(*a*) are respective cross-sectional plan views in part of two types of conventional impellers depicting CFD velocity vectors of a fluid in the region of an auxiliary vane.
Figure 6A:
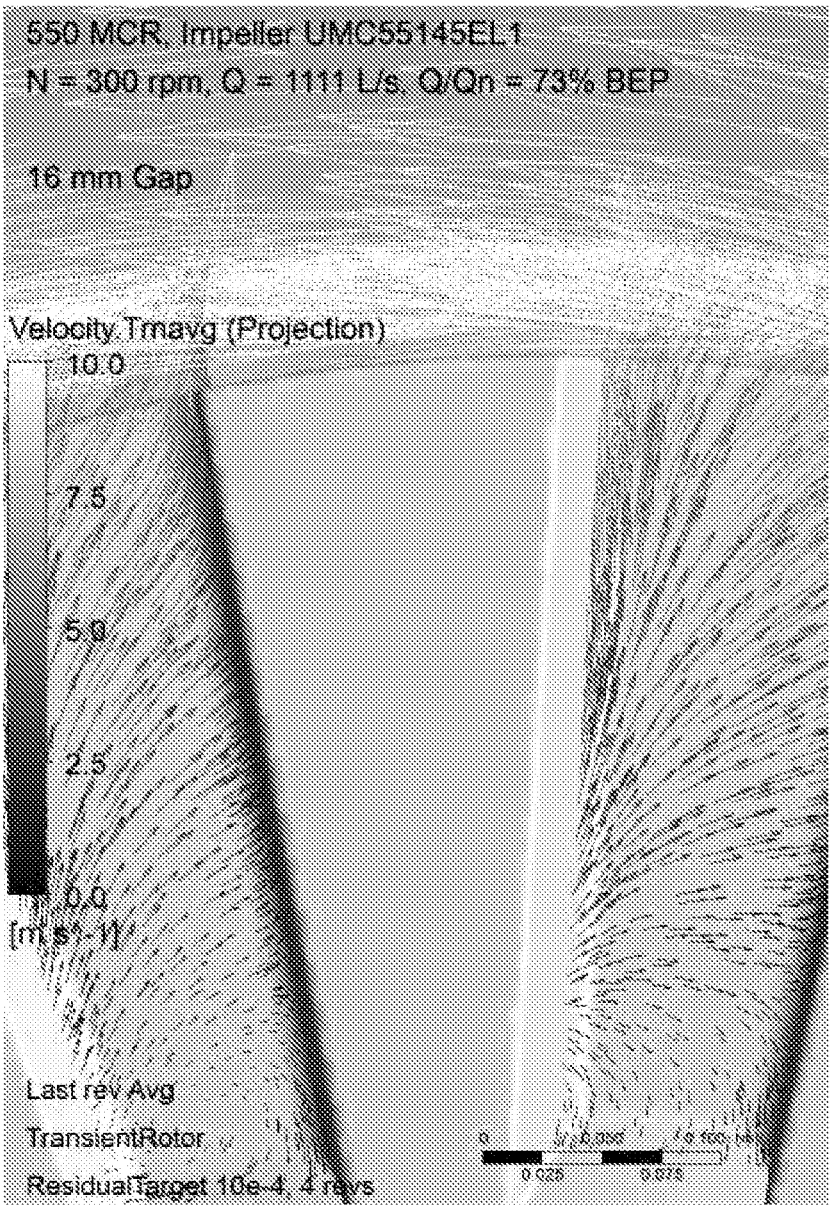
Figure 7:
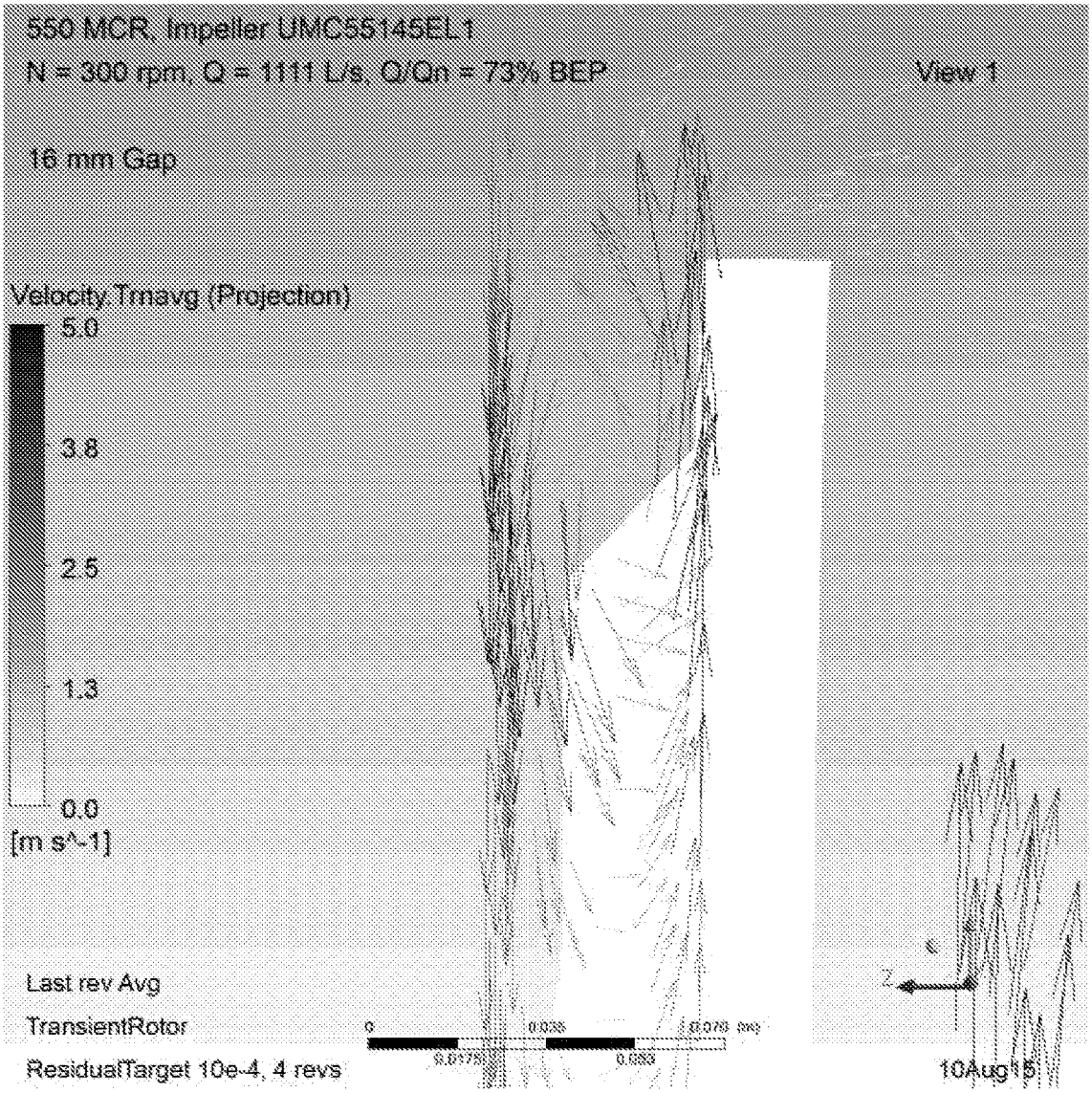
FIGS. 7 and 7(*a*) are respective side views of an auxiliary vane of the conventional impellers of FIGS. 6 and 6(*a*) depicting CFD velocity vectors of a fluid in the region of an auxiliary vane.
Figure 7A:
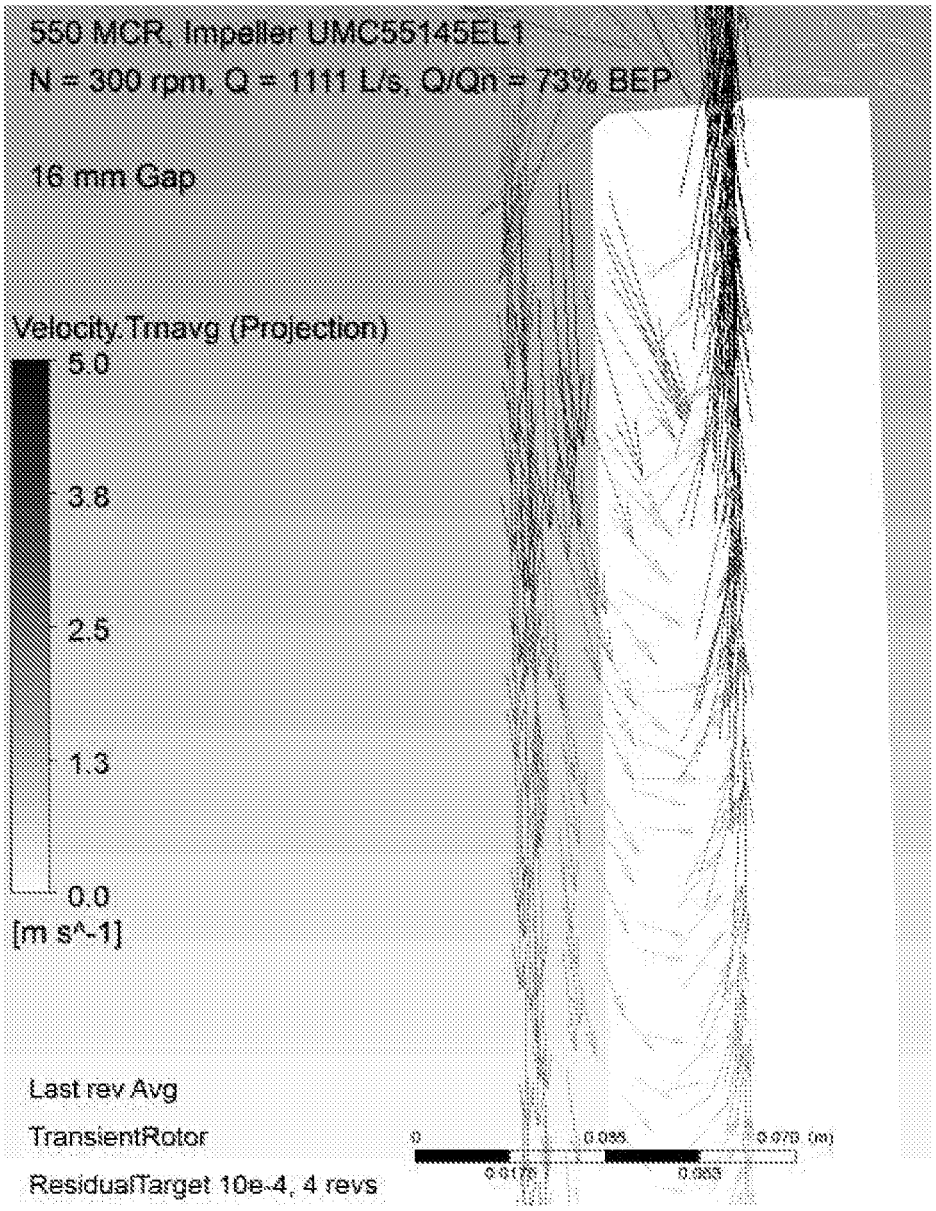

FIGS. 6 to 9(*a*) are generated by computational fluid dynamics analysis using ANSYS CFX v16.1 software. FIGS. 6 and 6(*a*) illustrate computer simulations of the velocity vectors created during operation of two types of impeller having conventional auxiliary vanes. As shown in both FIG. 6 and FIG. 6(*a*), there is an outward radial flow in the region of the trailing side of the auxiliary vane which intersects with a tangential flow at the outer edge or vane tip of the auxiliary vane. It is these intersecting flows which generate a strong tip vortex. FIGS. 7 and 7(*a*) both clearly show the vortex generated. It is this tip vortex which causes significant wear on the respective impeller when it is exposed to a particulate slurry material during operation of the impeller in a pump.

Figure 8:
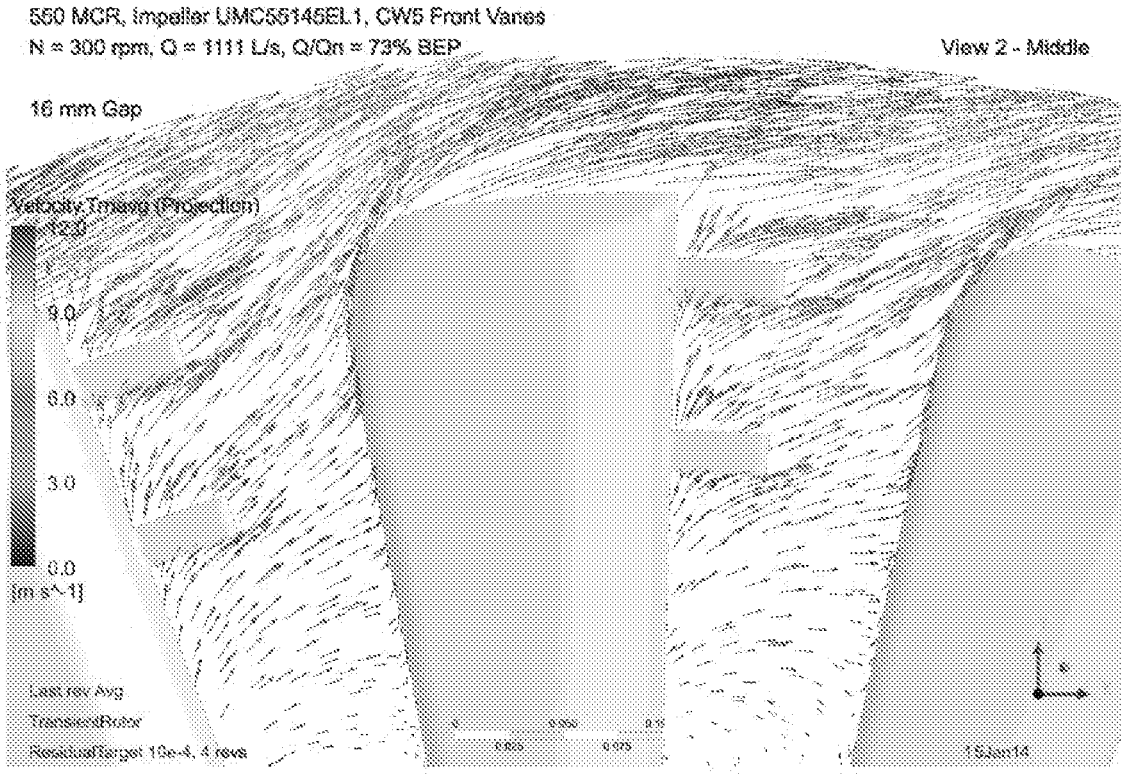
FIGS. 8 and 8(*a*) are elevational views of two impellers in accordance with embodiments of the present disclosure, depicting CFD velocity vectors in the region of a modified auxiliary vane, according to an embodiment of the present disclosure.
Figure 8A:
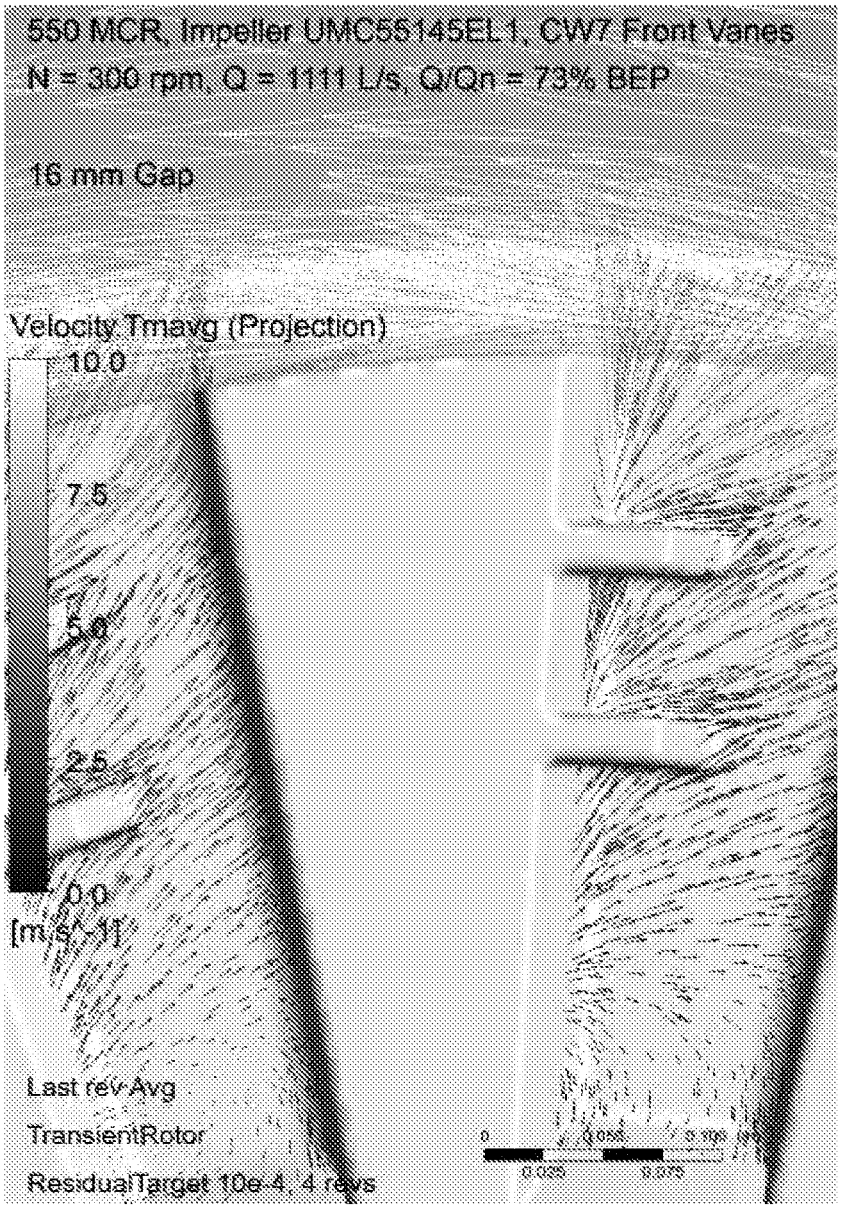
Figure 9:
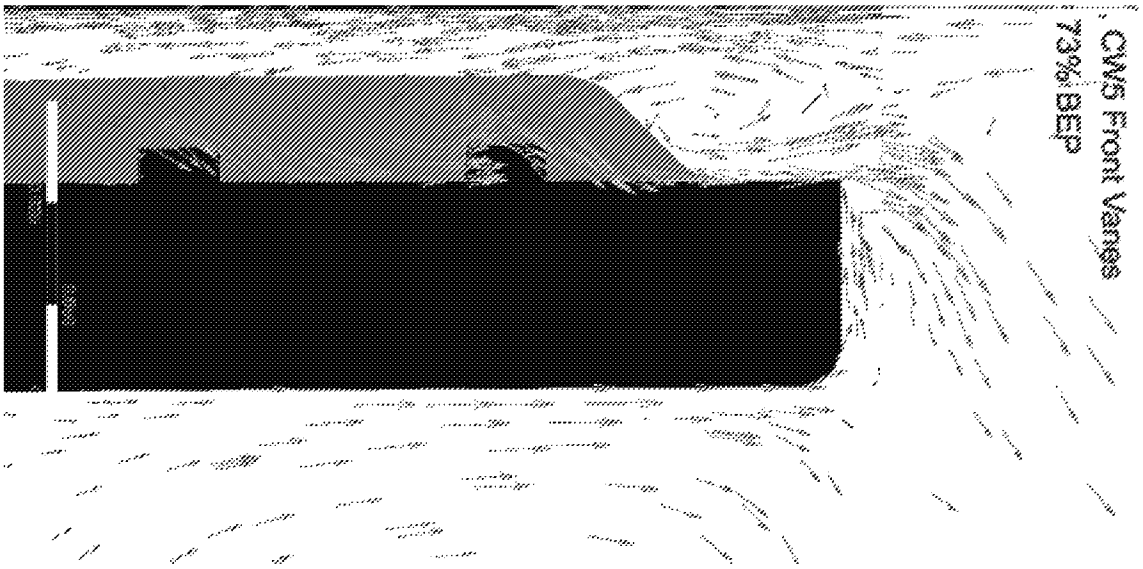
FIGS. 9 and 9(*a*) are side views of an auxiliary vane of the two impellers of FIGS. 8 and 8(*a*) depicting CFD velocity vectors in the region of a modified auxiliary vane, according to an embodiment of the present disclosure.
Figure 9A:
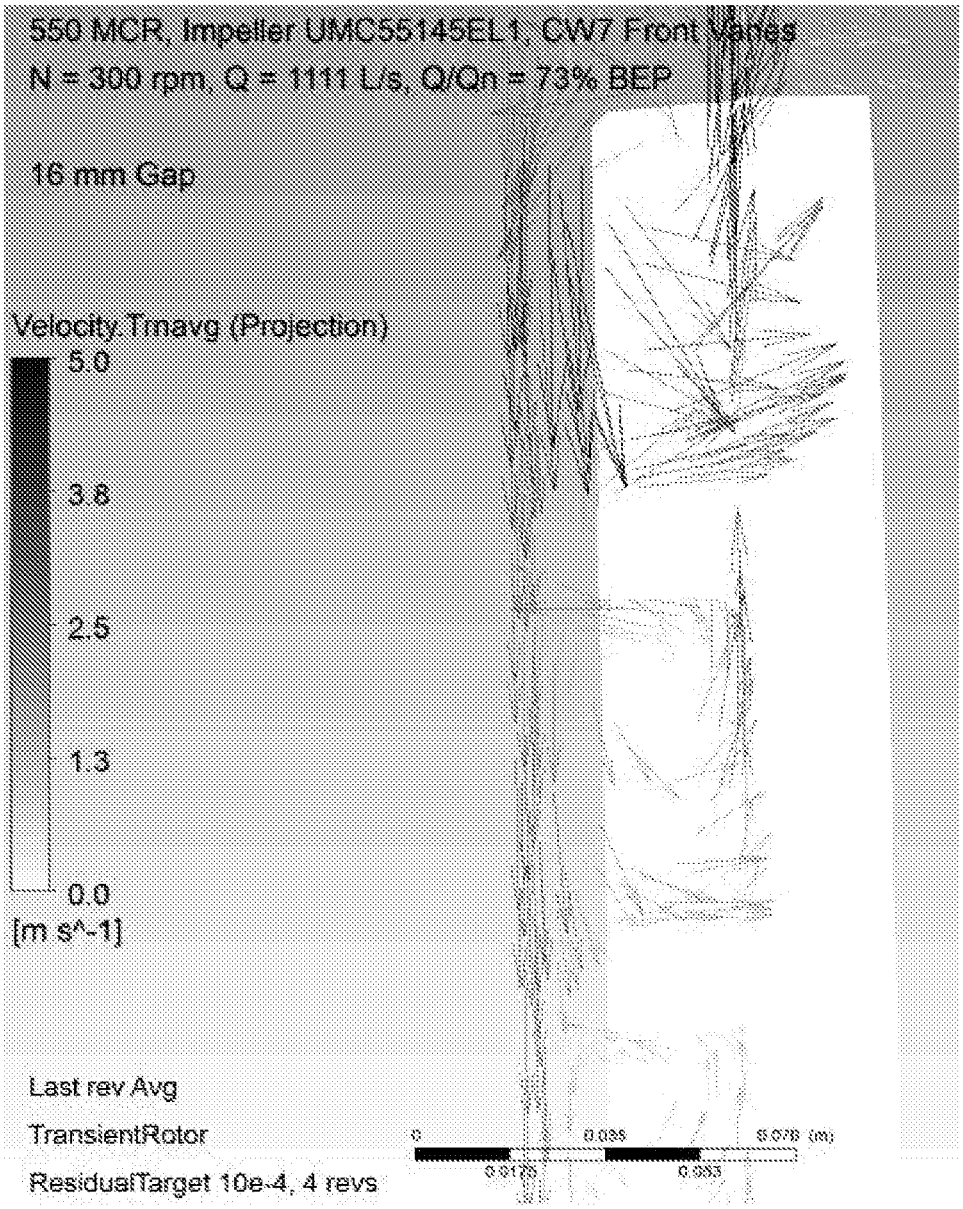

FIGS. 8, 8(*a*), 9 and 9(*a*) illustrate computer simulations of the effect of the projections on the velocity vectors and the tip vortex generated in two different embodiments which feature the use of the auxiliary vanes having trailing side projections. As can be seen in each case, these projections provide that the radial outflow on the shroud is disturbed or deflected, and is thus reduced. As illustrated in the FIGS. 8 and 8(*a*), the outward radial velocity behind the auxiliary vanes near the tip is only 4.5 m/s. The cross sectional view in FIGS. 9 and 9(*a*) shows a reduced strength in the vortex generated at the outer edge or tip of the vane when compared to the impeller having conventional auxiliary vanes.

Reducing the outflow velocity behind the auxiliary vane from 7.5 to 4.5 m/s reduces the wear rate at the tip of the vane by approximately the square of the velocity ratio. The expected wear of the impeller shroud with the projection is thus 60% less than the conventional auxiliary vane shroud.

In the foregoing description of preferred embodiments, specific terminology has been resorted to for the sake of clarity. However, the invention is not intended to be limited to the specific terms so selected, and it is to be understood that each specific term includes all technical equivalents which operate in a similar manner to accomplish a similar technical purpose. Terms such as "top" and "bottom", "front" and "rear", "inner" and "outer", "above", "below", "upper" and "lower" and the like are used as words of convenience to provide reference points and are not to be construed as limiting terms.

The reference in this specification to any prior publication (or information derived from it), or to any matter which is known, is not, and should not be taken as, an acknowledgement or admission or any form of suggestion that prior publication (or information derived from it) or known matter forms part of the common general knowledge in the field of endeavor to which this specification relates.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

The reference numerals in the following claims do not in any way limit the scope of the respective claims.

| Table of Parts | |
|---|---|
| Pump | 10 |
| Pump casing (volute) | 12 |
| Back liner | 14 |
| Inner face | 16 |
| Front liner | 30 |
| Pump outlet | 18 |
| Internal chamber | 20 |
| Central or rotational axis | X-X |
| Delivery section | 32 |
| Passage | 33 |
| Outer end | 34 |
| Inner end | 35 |
| Sidewall section | 15 |
| Inner face | 37 |
| Lip | 38 |
| Impeller | 40 |
| Hub | 41 |
| Pumping vanes | 42 |
| Eye portion | 47 |
| Impeller inlet | 48 |
| Front shroud | 50 |
| Back shroud | 51 |
| Outer peripheral edge portion | 57 |
| Inner face | 55 |
| Outer face | 54 |
| Inner face | 53 |
| Outer face | 52 |
| Auxiliary vanes (first group) | 60 |
| Auxiliary vanes (second group) | 61 |
| Inner edge | 63 |
| Outer edge | 65 |
| Leading side | 66 |
| Trailing side | 67 |
| Upper side | 69 |
| Main surface | 71 |
| Inclined surface | 72 |
| Second surface | 73 |
| Projections | 80, 81, 82 |
| Inner side | 85 |
| Outer side | 86 |
| Top side | 87 |
| End side | 88 |

The invention claimed is:

1. An impeller configured to rotate about a rotation axis X-X, the impeller comprising a shroud having opposed inner and outer faces and an outer peripheral edge portion remote from the rotation axis X-X, a plurality of pumping vanes projecting from the inner face of the shroud, a plurality of auxiliary vanes projecting from the outer face of the shroud, one or more of the auxiliary vanes having an inner edge positioned closer to the rotation axis X-X and an outer edge positioned closer to the peripheral edge portion of the shroud, one or more of the auxiliary vanes extending in a direction between the rotation axis X-X towards the outer peripheral edge portion of the shroud, one or more of the auxiliary vanes having a leading side and a trailing side that is positioned between the inner edge and the outer edge of the auxiliary vane, with an upper side spaced from the outer face of the shroud, and one or more projections extending from the trailing side of one or more of the said auxiliary vanes said one or more projections being spaced from said outer edge towards said inner edge, wherein one or more of the projections is generally oblong in shape and has an inner side closest to the rotation axis X-X, an outer side remote from the rotation axis X-X, and an end side, which is remote from the auxiliary vane with which the projection is associated.

2. An impeller according to claim 1, comprising two shrouds that include the shroud, which is a front shroud, and a back shroud, the shrouds having opposed inner and outer faces, said pumping vanes extending between the inner faces of the shrouds, the shroud having a central intake opening therein with a first group of said auxiliary vanes on the outer face thereof which are disposed between the intake opening and the outer peripheral edge portion of the shroud.

3. An impeller according to claim 2, wherein a second group of said auxiliary vanes are disposed on said outer face of the back shroud.

4. The impeller according to claim 1, wherein the outer edge of the auxiliary vanes is spaced inwardly from the outer peripheral edge portion of the shroud.

5. The impeller according to claim 1, wherein the outer edge of the auxiliary vanes is at the peripheral edge portion of the shroud.

6. The impeller according to claim 1, wherein one or more of the auxiliary vanes comprises a plurality of said projections disposed in spaced apart relation on the trailing side thereof.

7. The impeller according to claim 6, wherein one of the plurality of said projections is an inner-most projection and another is an outer-most projection, the outer-most projection being more closely spaced from the outer edge of the auxiliary vane than the inner-most projection.

8. The impeller according to claim 7, wherein the inner-most projection is more closely spaced from the inner edge of the auxiliary vane than the outer-most projection.

9. The impeller according to claim 1, wherein a plurality of said one or more projections each has a length C which is taken from the trailing side of the auxiliary vane with which it is associated to the end side thereof.

10. The impeller according to claim 1, wherein a plurality of said one or more projections each has a length which is taken from the trailing side of the auxiliary vane with which it is associated to the end side thereof, wherein the length of at least one of the projections of the plurality of said one or more projections is different from the length of at least one other of the projections of the plurality of said one or more projections.

11. The impeller according to claim 10, wherein the length of the outermost projection is the longest and the innermost projection is the shortest.

12. The impeller according to claim 1, wherein one or more of the projections has a top side remote from the outer face of the shroud with which it is associated, and the upper side of the auxiliary vane with which it is associated has a main surface, and where HE is the height of the auxiliary vane from the outer face of the shroud to the main surface of the upper side of the auxiliary vane, and H is the height of the projection from the outer face of the shroud to the top side of the projection.

13. The impeller according to claim 12, wherein H is less than 0.7 of HE.

14. The impeller according to claim 12, wherein H ranges from 0.2 to 0.69 of HE.

15. The impeller according to claim 12, wherein the vanes have one said projection associated therewith wherein H is generally equal to HE.

16. The impeller according to claim 12, wherein the vanes have two said projections associated therewith wherein H is generally equal to HE.

17. The impeller according to claim 12, wherein the vanes have two said projections associated therewith wherein H is less than HE.

18. The impeller according to claim 12, wherein the vanes have associated therewith two said projections wherein for one projection H is generally equal to HE and for the other projection H is less than HE.

19. The impeller according to claim 1, wherein DE is the length in a radial direction from the rotation axis X-X to the outer edge of the auxiliary vane, and DF1 is the length in a radial direction from the rotation axis X-X to the outer side of an outer-most projection, and arranged such that DF1 is less than 0.95 of DE.

20. The impeller according to claim 19, wherein DF1 ranges from 0.85 to 0.94 of DE.

21. The impeller according to claim 1, wherein DE is the length in a radial direction from the rotation axis X-X to the outer edge of the auxiliary vane and DF2 is the length in a radial direction from the rotation axis X-X to the outer side of an intermediate projection, and arranged such that DF2 is less than 0.85 of DE.

22. The impeller according to claim 21, wherein DF2 ranges from 0.35 to 0.84 of DE.

23. The impeller according to claim 1, wherein DE is the length in a radial direction from the rotation axis X-X to the outer edge of the auxiliary vane and DF3 is the length in a radial direction from the rotation axis X-X to the outer side of an inner-most projection, and arranged such that DF3 is less than 0.75 of DE.

24. The impeller according to claim 23, wherein DF3 ranges from 0.35 to 0.74 of DE.

25. The impeller according to claim 1, wherein T is the distance from the outer side of the projection to the inner side, and DE is the length in a radial direction from the rotation axis X-X to the outer edge of the auxiliary vane, and arranged such that T is from 0.2 to 0.1 of DE.

26. The impeller according to claim 1, wherein L is the angle made from the rotation axis X-X between the trailing side of an auxiliary vane and the end side of a projection extending therefrom, and LE is the angle made from the rotation axis X-X between the trailing side of one auxiliary vane to the leading side of an adjacent auxiliary vane, and arranged such that L is less than 0.7 of LE.

27. The impeller according to claim 26, wherein L ranges from 0.1 to 0.69 of LE.

28. The impeller according to claim 1, wherein one or more of the projections have a top side remote from the outer face of the shroud, and the upper side of the auxiliary vane has a main surface, and the upper side has a stepped surface which is stepped down from the main surface and is in the region of the outer edge.

* * * * *